US007765897B2

(12) United States Patent
Kim et al.

(10) Patent No.: US 7,765,897 B2
(45) Date of Patent: Aug. 3, 2010

(54) RATCHET WRENCH

(75) Inventors: Jae Soo Kim, Yongin-si (KR); Byeong Ok Woo, Ulsan (KR)

(73) Assignee: World Tools Co., Ltd., Ulsan (KR)

( * ) Notice: Subject to any disclaimer, the term of this patent is extended or adjusted under 35 U.S.C. 154(b) by 107 days.

(21) Appl. No.: 12/152,991

(22) Filed: May 19, 2008

(65) Prior Publication Data

US 2009/0255378 A1 Oct. 15, 2009

(30) Foreign Application Priority Data

Apr. 11, 2008 (KR) ..... 10-2008-0033591

(51) Int. Cl.
*B25B 13/46* (2006.01)

(52) U.S. Cl. ..... 81/60; 81/159; 81/163; 81/447; 81/177.85

(58) Field of Classification Search ..... 81/60–63.2, 81/58.2, 155, 159–160, 163, 447, 180.1, 81/185.1, 185, 177.85
See application file for complete search history.

(56) References Cited

U.S. PATENT DOCUMENTS 781,305 A * 1/1905 Rugg ..... 81/63
928,764 A * 7/1909 Jenrich ..... 81/63.2
1,280,482 A * 10/1918 Isenor ..... 81/62
1,775,402 A * 9/1930 Mandl ..... 81/177.75
2,801,562 A * 8/1957 Stricklett et al. ..... 81/163
4,112,792 A * 9/1978 Guimarin ..... 81/63
4,437,365 A * 3/1984 Yaari ..... 81/436
4,813,309 A * 3/1989 Kang ..... 81/57.43
5,438,894 A * 8/1995 Pearce ..... 81/177.2
6,629,477 B2 * 10/2003 Ling et al. ..... 81/63.2
6,918,323 B2 * 7/2005 Arnold et al. ..... 81/63.2
2005/0145074 A1 * 7/2005 Mau ..... 81/63

* cited by examiner

*Primary Examiner*—D. S Meislin
(74) *Attorney, Agent, or Firm*—Ladas & Parry LLP

(57) ABSTRACT

A ratchet wrench is disclosed, which comprises a body unit which has a circular groove at its one side and a stop member; a head unit which includes a housing rotatably passing through a circular groove of the body unit, and a ratchet gear engaged at an outer rim of the housing and is selectively rotatable in one direction as the ratchet gear is engaged with the stop member; a worm screw which is rotatably pin-engaged in the interior of the housing; and a pair of arms of which one end of each arm is inserted into the interior of the housing and is pin-engaged therein with a thread being formed on an upper side of each arm and being engaged with the worm screw.

13 Claims, 7 Drawing Sheets

RATCHET WRENCH

TECHNICAL FIELD

The present invention relates to a ratchet wrench, and in particular to a ratchet wrench which makes it possible to continuously engage or disengage bolts and nuts with various sizes without additionally using a socket and to engage or disengage a bolt and a nut even in a relatively deep groove of a work object.

BACKGROUND ART

Generally, it is known that a ratchet wrench is a tool used for tightening or loosening a bolt or a nut. The ratchet wrench might be classified into various types depending on its size, type and use method.

In a conventional art, as shown in FIG. 1, a ratchet wrench comprises a body 10, a head unit 30 which is engaged at one side of the body 10 with a ratchet gear being attached to its outer rim, a handle unit 20 which is engaged at the other side of the body 10, and a socket 40 which is inserted into the head unit 30 and is equipped with a groove for receiving a bolt or a nut.

When it is needed to engage or disengaged a bolt or a nut by using a ratchet wrench, the handle unit 20 is rotated at a certain angle in one direction or in the other direction, and the head unit 30 and the socket 40 rotate, so the bolt head 50 inserted into the socket 40 rotates for thereby tightening or loosening the bolt.

However, since the socket of the conventional latchet wrench can be used only when engaging or disengaging the bolt of a single standard size, it should be disadvantageous that various different sizes sockets are used when engaging or disengaging different size sockets, which leads to many inconveniences in use.

When different size bolts are needed to be engaged or disengaged, a corresponding bolt is engaged or disengaged by using one ratchet wrench, and then the socket is disengaged from the head unit, and a new socket with a different size is engaged to the head unit for thereby engaging or disengaging a different size bolt. Whenever it is needed to engage or disengage the different size bolts, the socket should be changed with a corresponding size socket for thereby engaging and disengaging different size bolts, respectively.

Since it is needed to equip with multiple sockets for different size bolts, a lot of cost is needed, and a heavy toolbox is needed for storing the different size bolts. In the conventional art, it is impossible to engage or disengage a bolt or a nut disposed in a deep groove of a work object.

SUMMARY OF THE INVENTION

Accordingly, it is an object of the present invention to provide a ratchet wrench which makes it possible to overcome the problems found in the conventional art.

It is another object of the present invention to provide a ratchet wrench which is able to continuously engage or disengage various size bolts or nuts without using an additional socket by providing a body unit which has a circular groove at its one side and a stop member, a head unit which includes a housing rotatably passing through a circular groove of the body unit, and a ratchet gear engaged at an outer rim of the housing and is selectively rotatable in one direction as the ratchet gear is engaged with the stop member, a worm screw which is rotatably pin-engaged in the interior of the housing, and a pair of arms of which one end of each arm is inserted into the interior of the housing and is pin-engaged therein with a thread being formed on an upper side of each arm and being engaged with the worm screw.

To achieve the above objects, there is provided a ratchet wrench which comprises a body unit which has a circular groove at its one side and a stop member; a head unit which includes a housing rotatably passing through a circular groove of the body unit, and a ratchet gear engaged at an outer rim of the housing and is selectively rotatable in one direction as the ratchet gear is engaged with the stop member; a worm screw which is rotatably pin-engaged in the interior of the housing; and a pair of arms of which one end of each arm is inserted into the interior of the housing and is pin-engaged therein with a thread being formed on an upper side of each arm and being engaged with the worm screw.

According to a preferred embodiment of the present invention, a control lever is provided in one outer side of the body unit and is connected with the stop member with an adjusting pin for thereby allowing the stop member to rotate.

According to a preferred embodiment of the present invention, the stop member is formed in a triangle shape and is equipped with a tooth member at both ends of one side of the same for thereby being engaged with the ratchet gear, and a pair of circular curved parts are formed as being near to each other at the other side of the same for thereby being closer to the ball of the first ball plunger provided in one side of the stop member.

According to a preferred embodiment of the present invention, the housing is formed in a cylindrical shape having a certain space in its interior with a rectangular worm screw insertion groove being formed for an engagement with the worm screw, and with an arm guide groove being formed in its lower surface for a slide movement of a pair of the arms.

According to a preferred embodiment of the present invention, the worm screw is constructed in such a manner that threads are symmetrical with each other with respect to its center, so a pair of arms rotate in the opposite direction to each other depending on the rotation of the worm screw.

According to a preferred embodiment of the present invention, a pair of the arms are equipped with opposite plane surfaces, and a V-shaped engaging groove is formed on the opposite surfaces of the arms, respectively.

According to a preferred embodiment of the present invention, an arcuate groove is further formed in a curved portion of the engaging groove.

According to a preferred embodiment of the present invention, a cover having a through hole is formed at one lower side of the body unit, and a lower end of the housing is exposed to the outside through the through hole.

According to a preferred embodiment of the present invention, there is further provided an adaptor which is detachably engaged to a lower end of each arm, and a wrench socket is attachable to or detachable from one side of the adaptor.

According to a preferred embodiment of the present invention, the adaptor includes an arm engaging unit having a guide unit protruded from a center of the arm engaging groove formed in the interior to the upper side, and a socket engaging unit which has a rectangular cross section and is protruded from the arm engaging unit to a downward direction.

According to a preferred embodiment of the present invention, a second ball plunger is disposed at one side of an inner surface of the arm engaging unit, and a plunger groove corresponding to the second ball plunger is formed at one side of an outer surface of each arm.

According to a preferred embodiment of the present invention, a third ball plunger is provided at one side of the socket engaging unit for an engagement with the wrench socket.

According to a preferred embodiment of the present invention, a handle unit made of a rubber or a synthetic resin material is provided on an outer surface of the other side of the body unit for preventing sliding.

In the ratchet wrench according to an embodiment of the present invention, it should be appreciated that it is possible to perform a continuous bolt engagement or disengagement work without an additional socket when different size bolts are engaged or disengaged by installing an arm in a head unit with the help of a simple construction of using a worm screw and by adjusting the arm with respect to the standard of a bolt head. Workability is significantly enhanced since a socket toolbox is not needed for storing different size sockets, and it does not cost too much.

In addition, it is possible to engage or disengage a bolt or a nut even in a deep groove formed in a work object as the length of an arm can be properly adjusted.

Engaging an adaptor in an arm can use various kinds of wrench sockets.

BRIEF DESCRIPTION OF THE DRAWINGS

The present invention will become better understood with reference to the accompanying drawings which are given only by way of illustration and thus are not limitative of the present invention, wherein.

DESCRIPTION OF PREFERRED MODES FOR CARRYING OUT THE INVENTION

The preferred embodiments of the present invention will be described with reference to the accompanying drawings.

Figure 2:
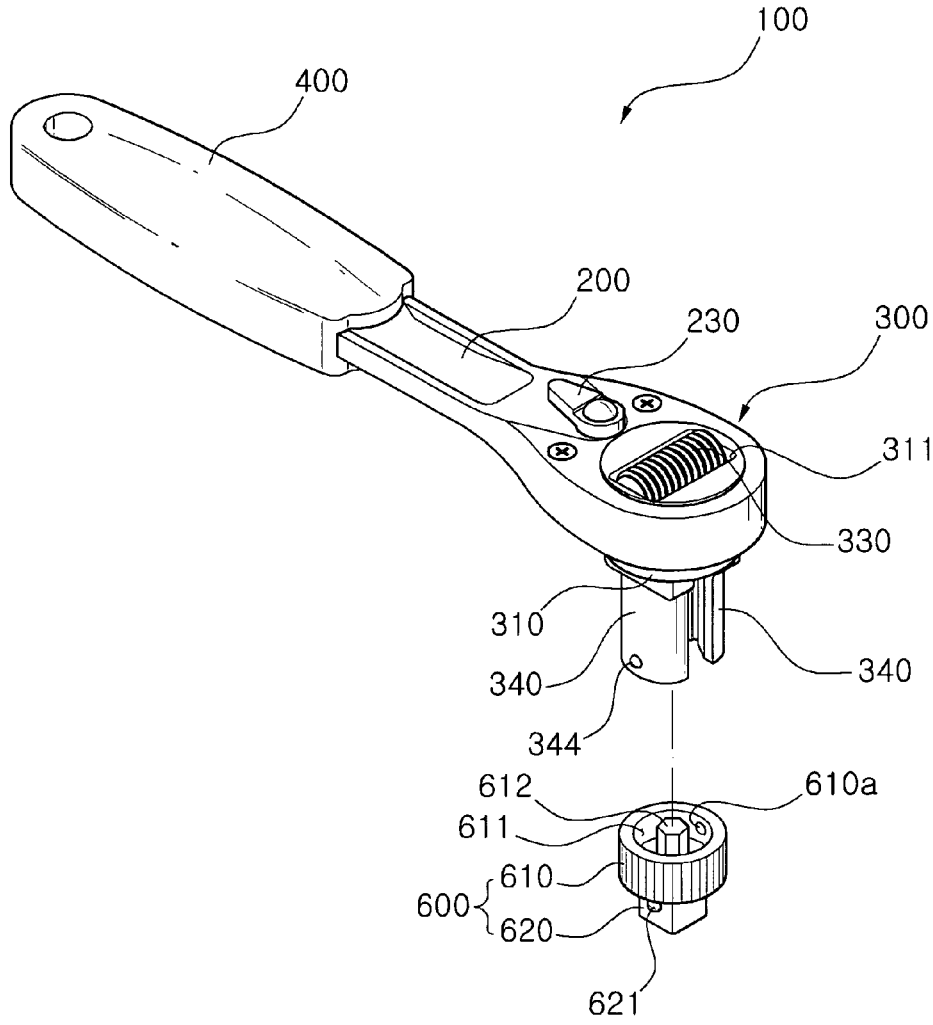
FIGS. 2 and 3 are perspective views illustrating a ratchet wrench according to an embodiment of the present invention.
Figure 3:
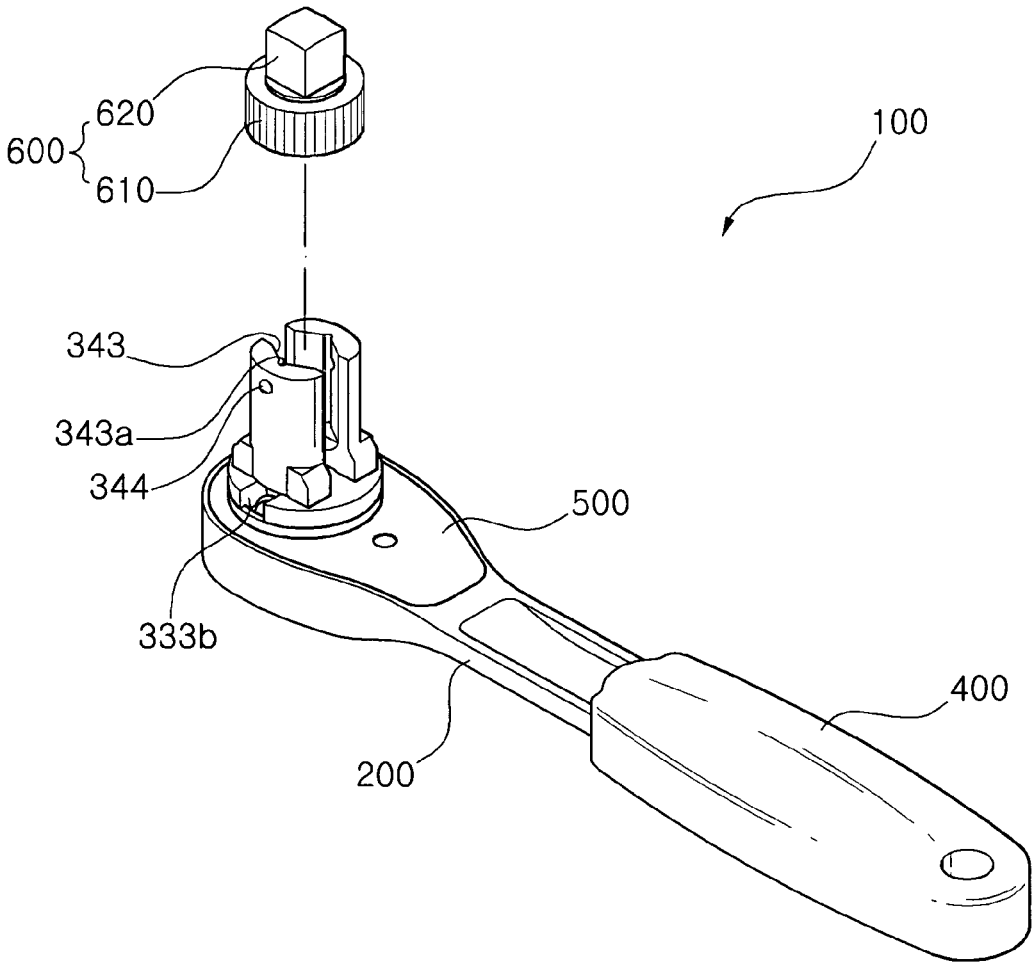
Figure 4:
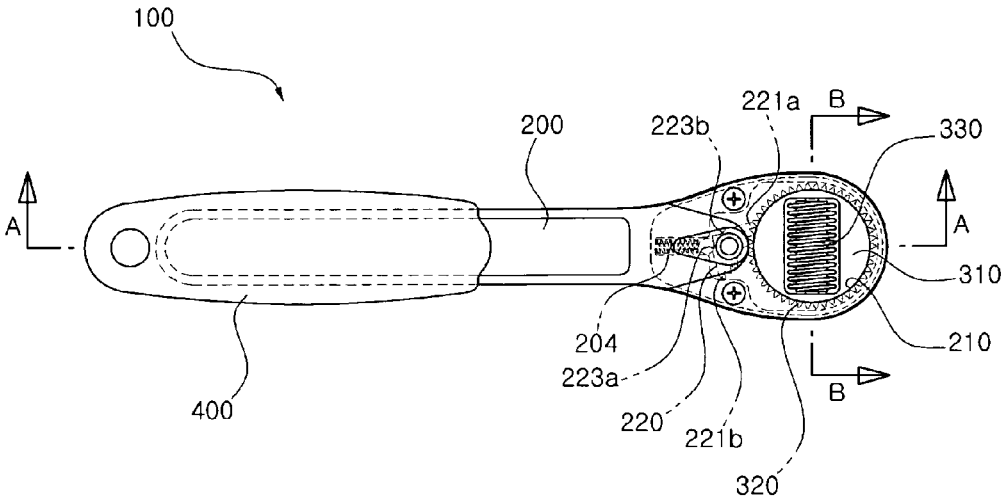
FIG. 4 is a plane cross sectional view illustrating a ratchet wrench according to an embodiment of the present invention.
Figure 5:
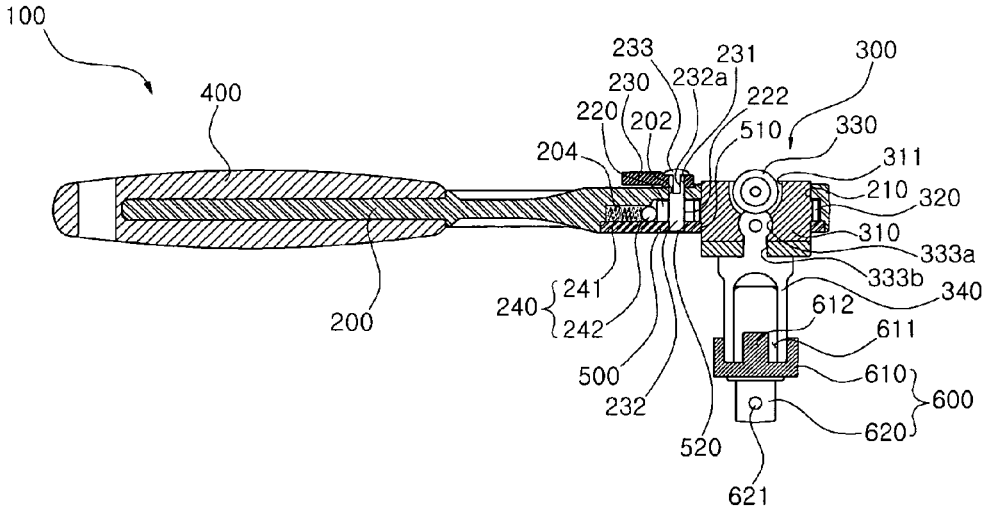
FIG. 5 is a cross sectional view taken along line A-A of FIG. 4.
Figure 6:
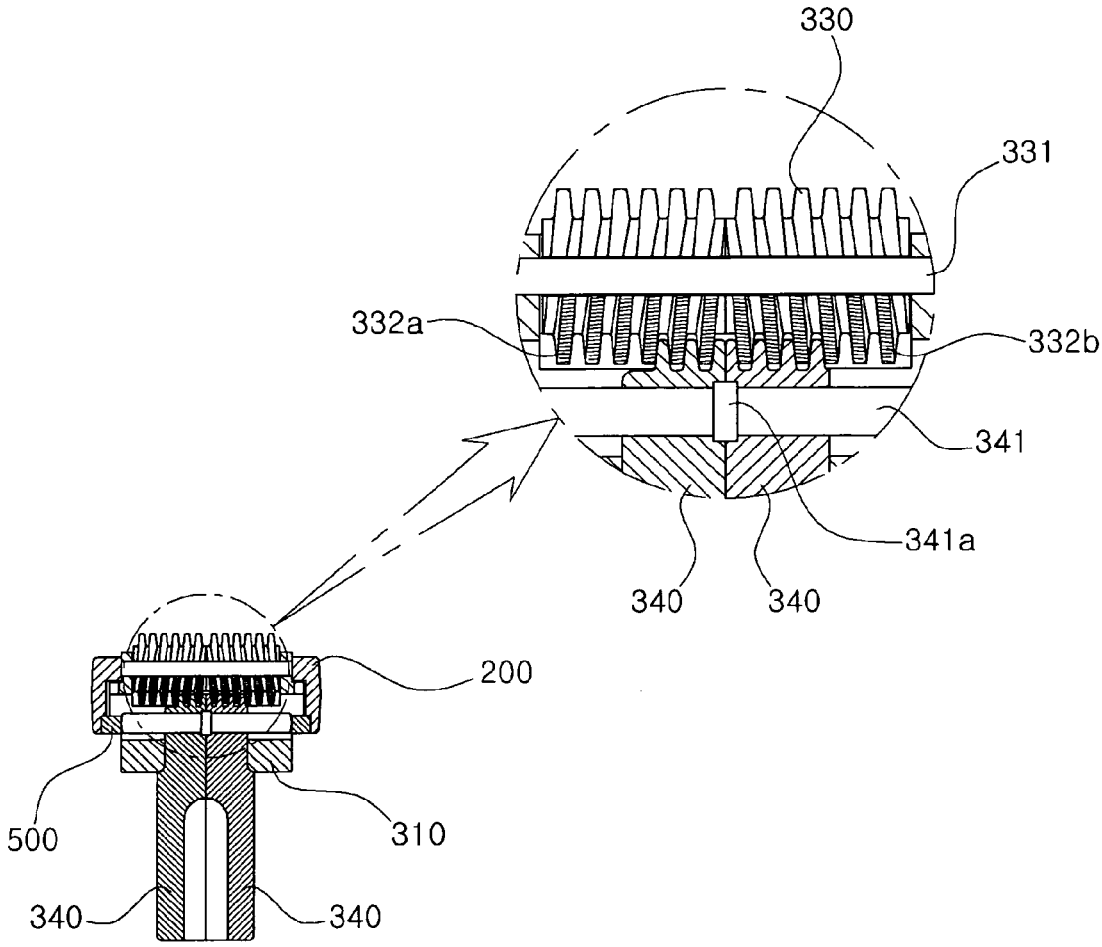
FIG. 6 is a cross sectional view taken along line B-B of FIG. 4.
Figure 7A:
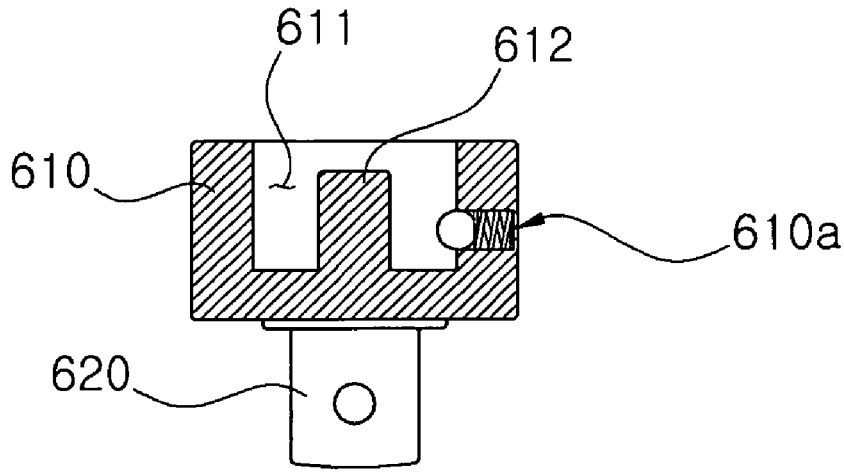
FIGS. 7A and 7B are views illustrating an adaptor according to an embodiment of the present invention.
Figure 7B:
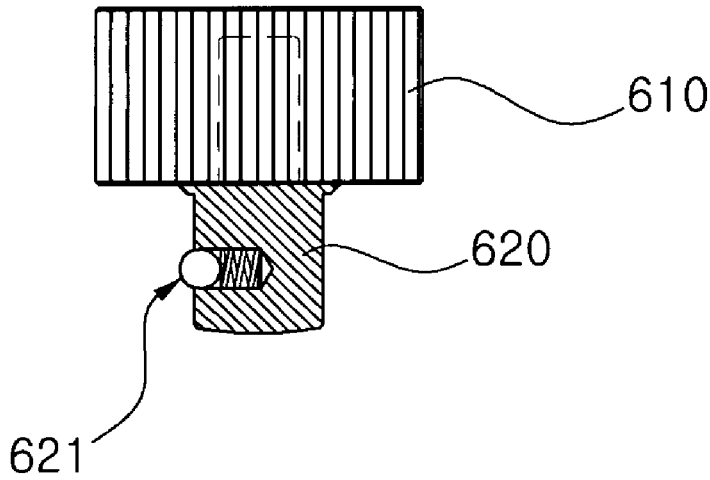
Figure 8:
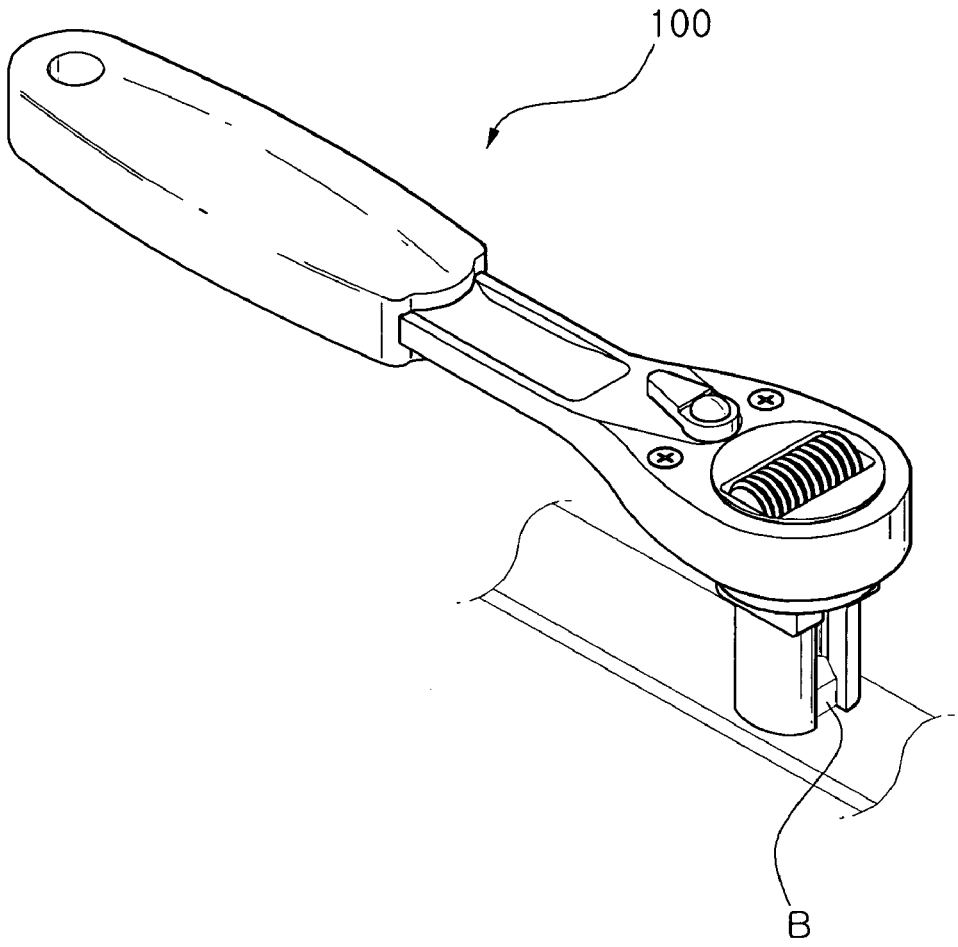
FIG. 8 is a view of a use state of a ratchet wrench according to an embodiment of the present invention.

FIGS. 2 and 3 are perspective views illustrating a ratchet wrench according to an embodiment of the present invention. FIG. 4 is a plane cross sectional view illustrating a ratchet wrench according to an embodiment of the present invention. FIG. 5 is a cross sectional view taken along line A-A of FIG. 4. FIG. 6 is a cross sectional view taken along line B-B of FIG. 4. FIG. 7 is a schematic view illustrating an adaptor according to an embodiment of the present invention. FIG. 8 is a view of a use state of a ratchet wrench according to an embodiment of the present invention.

As shown in FIGS. 2 through 6, the ratchet wrench 100 according to an embodiment of the present invention comprises a body unit 200 and a head unit 300. More preferably, the ratchet wrench 100 further comprises a handle unit 400, a cover 500 and an adaptor 600.

A circular hole 210 is formed in one side of the body unit 200, and the handle unit 400 is formed in an outer surface which is longitudinally extended in the direction of the other side of the body unit 200. It is preferred that the handle unit 400 is made of a smooth rubber or silicon or synthetic resin material, which allows a user to easily grab without slipping.

More specifically, the body unit 200 is integrally made except for the portion in which the cover 500 is inserted. With the above construction, any movement does not occur in the body unit when a bolt or a nut is engaged or disengaged.

The cover 500 is detachably engaged to one lower side of the body unit 200 with the help of a certain engaging member such as a bolt or the like while stably supporting a housing 310 and a first ball plunger 240, which will be described later. The cover 500 is equipped with a circular through hole 510 at one side of the same for receiving the housing 310 therein, and a cover hole 520 at the other side of the same with an adjusting pin, which connects a stop member 220 and a control lever 230, being rotatably inserted into the cover hole 520.

As shown in FIG. 4, the stop member 220 is disposed in the interior of the body unit 200. The stop member 220 is engaged with a ratchet gear 320 of the head unit 300, so the head unit 300 rotates in one direction.

The stop member 220 is formed in a triangle shape, and tooth members 221*a* and 221*b* engaged with the ratchet gear 320 are preferably formed at both ends of one side of the stop member 220. The stop member 200 is provided with a stop member hole 222 with an adjusting pin passing through the stop member hole 222 for allowing the control lever 230 to be connected with a control lever 230.

The tooth members 221*a* and 221*b* are entangled by the ratchet gear 320 in one direction, and are not entangled and move over the ratchet gear 320 in the other direction, and are slanted at certain angles from its center to an outer direction.

As shown in FIG. 4, when the body unit 200 is rotated in the clockwise direction, the stop member engaged in the body unit 200 rotates along with the body unit 200. At this time, since the tooth member 221*a* of the stop member 220 is entangled by means of the ratchet gear 320, the stop member 220 transfers a rotational force to the ratchet gear 320, so the housing 310 can rotate along with the body unit 200.

When the body unit 200 is rotated in the reverse direction, since the tooth member 221*a* of the stop member 220 moves over the ratchet gear 320, a rotational force is not transferred to the housing 310, so only the body unit 200 rotates, and the housing 310 does not rotate.

As not shown in FIG. 4, in a state that the tooth member 221*b* of the other side of the stop member 220 is engaged with the ratchet gear 320, when the body unit 200 is rotates in the clockwise direction, the tooth member 221*b* of the stop member 220 moves over the ratchet gear 320, so the housing 320 does not rotate. When the body unit 200 is rotated in the counterclockwise direction, the tooth member 221*b* of the stop member 220 pushes the ratchet gear 320 and provides the housing 310 with a rotational force, so the housing 310 rotates along with the body unit 200.

A pair of circular curved portions 223*a* and 223*b* are formed in the other side of the stop member 220, namely, are formed opposite to the portion in which the tooth members 221*a* and 221*b* are formed. With the above construction, a semiautomatic rotation of the stop member 220 is possible. The above construction will be described in detail later along with the control lever 230.

The control lever 230 installed in one outer side of the body unit 200 allows the stop member 220 to selectively rotate in one direction. As shown in FIGS. 4 and 5, the control lever 230 is installed in outer side of the body unit 200 and is connected with the stop member 220 through an adjusting pin and is equipped with a lever hole 231 through which the adjusting pin passes fixedly.

As shown in FIG. 5, the adjusting pin, which connects the control lever 230 and the stop member 220, consists of a first adjusting pin 232 and a second adjusting pin 233. The first adjusting pin 232 is inserted through the lever hole 231, the body unit hole 202 of the body unit 200, the stop member hole 222 of the stop member 220, and the cover hole 520 of the cover 500. The first adjusting pin 232 is equipped with an insertion groove 232*a* on its upper side.

The second adjusting pin 233 is fixedly inserted into the insertion groove 232*a* of the first adjusting pin 232 with its head being mounted on the upper surface of the control lever 230 for thereby enhancing an engagement fixing force of the first adjusting pin 232 and preventing its escape.

The first adjusting pin 232 is formed in a circular column shape and is rotatable in the body unit hole 202 of the body unit and the cover hole 520 of the cover, respectively.

At this time, when the control lever 230 rotates, the control lever 230 and the stop member 220 are rotated together. When the lever hole 231 of the control lever 230 and the stop member hole 222 of the stop member 220 are formed in circular shapes, the holes might be worn out and become loosened, so the first adjusting pin 232 does not help rotating the control lever 230 and the stop member 220, namely it idly rotates.

It is preferred that the lever hole 231 of the control lever 230 and the stop member hole 222 of the stop member 220 are formed in rectangular shapes, and the portions engaged to the lever hole 231 of the control lever 230 and the stop member hole 222 of the stop member 220 are preferably formed in rectangular shapes, respectively.

The body unit hole 202 of the body unit 200 and the cover hole 520 of the cover 500 and the portions of the first adjusting pin 232 corresponding to the above elements are preferably equipped with the diameters enough to pass through the above rectangular shapes. So, when the first adjusting pin 232 is inserted, it might be smoothly inserted without interfering with the lever hole 231 of the control lever 230 and the stop member hole 222 of the stop member 220.

The control lever 230 rotates at a certain angle, and the stop member 220 rotates together with the help of the first adjusting pin 232 when the control lever 230 rotates, so the tooth members 221*a* and 221*b* formed in both ends of one side of the same can be selectively engaged with the ratchet gear 320.

As shown in FIG. 4, when the tooth member 221*a* of one side of the stop member 220 is engaged with the ratchet gear 320 as the stop member 220 is rotated by means of the control lever 230, the housing 310 rotates along with the body unit 200 only when the body unit 200 is rotated in the clockwise direction as seen in the drawings for thereby performing an engaging work of a bolt, but it does not rotate in the counterclockwise direction.

When the tooth member 221*b* of the other side of the stop member 220 is engaged with the ratchet gear 320 as the stop member 220 rotates by means of the control lever 230, the housing 310 rotates only in the counterclockwise direction for thereby performing a disengaging work of the bolt.

According to a preferred embodiment of the present invention, when the stop member 220 is rotated by means of the control lever 230, a first ball plunger 240 is provided in one side of the stop member 220 so that its rotation can be performed in a semiautomatic manner.

The ball plunger is formed of an elastic spring and a ball, and the ball is movable in one direction by means of an elastic recovery force of the elastic spring.

As shown in FIGS. 4 and 5, the first ball plunger 240 allows the elastic recovery force by means of the elastic spring 241 to be transferred to the stop member 220 as the elastic spring 241 is mounted on the spring insertion groove 204 of the body unit 200 with its one end being fixed at the body unit 200, and the ball 242 is disposed between the other end of the elastic spring 241 and the stop member 220.

In the stop member 220, a pair of circular curved portions 223*a* and 223*b* are disposed being near from each other. The circular curved portions 223*a* and 223*b* are equipped with curvature radiuses being closer to the rim surface of the ball 242.

As shown in FIG. 4, the ball 242 is closer to the circular curved portion 223*a* of one side of the stop member 220. When the stop member 220 is rotated in the counterclockwise direction by means of the control lever 230, the ball 242 slides by means of the stop member 220 for thereby compressing the elastic spring 241, and when an apex portion between the circular curved portions 223*a* and 223*b* of the stop member 220 contacts with the ball 242, the elastic spring 241 is compressed in maximum. When the stop member 220 further rotates, the stop member 220 is automatically rotated in a full range by means of the elastic recovery force of the elastic spring 241 at the time when the circular curved portion 223*b* of the other side closely contacts with the ball 242, so the tooth member 221*b* of the other side is engaged with the ratchet gear 220.

The head unit 300 comprises a housing 310, a ratchet gear 320, a worm screw 330, and a pair of arms 340.

The housing 310 is formed in a cylindrical shape with a certain space being formed in the interior of the housing. The housing 310 rotatably passes through the circular hole 210 of the body unit 200, and the ratchet gear 320 is engaged at an outer rim of the housing 310.

A worm screw insertion groove 311 is formed on an upper surface of the housing 310 in a rectangular shape. A worm screw 330 is pin-engaged in the interior of the housing 310 by means of the worm screw pin 331, so a user can easily operate the worm screw 330. It is preferred that the upper side of the worm screw 330 is exposed to the outside through the insertion groove 311, and an outer surface of the worm screw 330 is knurled for preventing its sliding.

A pair of arms 340 are pin-engaged to the housing 310 by means of the arm pin 341 in a lower side of the worm screw 330, and a lower side of each arm 340 is exposed to the outside, and an arm groove 333*a* having a circular cross section is formed in a longitudinal direction of the worm screw 330 in a lower side of the worm screw insertion groove 311. An upper side of each arm 340 is inserted into the arm groove 333*a* with the help of the arm pin 341.

An arm guide groove 333*b* is formed in a lower surface of the housing 310 in a longitudinal direction of the worm screw 330 so that each arm 340 slides in a longitudinal direction of the worm screw 330. The arm groove 333*a* and the arm guide groove 333*b* guide the slide movement of each arm 340 and prevent the movement and distortion of the arm 340 when a rotational force is applied to the bolt fixed between the arms 340.

As shown in FIG. 3, the upper sides of both sides of each arm 340 are extended in a perpendicular direction with respect to the arm guide groove 333*b* and are closer to the lower side of the housing 310, so it is possible to prevent the movement of each arm 340 when bolts are engaged or disengaged for thereby allowing each arm 340 can be stably engaged to the housing 310.

In addition, a thread is formed on an upper side of each arm 340 and is engaged with the worm screw 330, respectively. It is preferred that the screws 332*a* and 332*b* of the worm screw 330 are symmetrically formed with respect to their centers. For example, as shown in FIG. 6, the left screw 332*a* when viewing with respect to the center of the worm screw 330 is slightly slanted in a right direction by means of a left hand screw process, whereas the screw 332*b* of the right side is slightly slanted in a right direction by means of a right hand screw process.

The arms 340 engaged at both sides of a lower side of the worm screw 330 slide in the opposite directions as the worm screw 330 rotates, and a center end 341*a* is protruded from the center of the arm pin 341, and each arm 340 reciprocates in a range from one end of the worm screw 330 to the center end 341*a*.

It is possible to adjust the distance between the arms 340 by means of an operation of the worm screw 330 depending on the sizes of the bolts (or nuts), so an additional socket is not needed when engaging or disengaging various size bolts or nuts.

The surface being opposite to the arms 340, namely, the surface contacting with the bolt head may be formed in a plane shape. Here, the above surface is fixedly contacted with an outer surface of the bolt head. However, in case that the opposite surface of the arm 340 is plane, a desired work cannot be easily performed since the arm 340 might be easily escaped from the bolt head. So, as shown in FIGS. 2 and 3, it is preferred that a V-shaped engaging groove 343 may be formed on the opposite surface of the arm 340. When the V-shaped groove is formed in the opposite surface of the arm 340, it does not contact with an outer surface of the bolt head, but an angle portion, in which the outer surfaces contact with each other, might be inserted into the engaging groove 343, so a fixing force becomes more stable, and the arm 340 cannot be easily escaped when engaging or disengaging the bolts.

When the curved portion of the engaging groove 343 contacts with an outer angle portion of the bolt head, the outer angle portion of the bolt head may be hurt by means of a friction occurring when engaging or disengaging the bolts. It is preferred that a semi-circular groove 343*a* is formed in a curved portion of the engaging groove 343, so an outer angle portion of the bolt head does not contact with the opposite surface of the arm 340 for thereby preventing damages.

A circular plunger groove 344 formed in a lower side of the opposite surface of each arm 340 is formed to engage with an adaptor 600. It will be described later when describing the adaptor 600.

The adaptor 600 is detachably engaged to a lower side of each arm 340 for thereby allowing an attaching and detaching of the wrench socket. As shown in FIGS. 2 and 3, an arm engaging unit 610 is formed in one side and is detachable from the arm 340. A socket engaging unit 620 having a rectangular cross section is formed in the other side for allowing the wrench socket to be detachable.

The arm engaging unit 610 includes an arm engaging groove 611 formed in the interior in a circular shape, and a guide unit 612 protruded from a center of the arm engaging groove 611 to an upper side. The guide unit 612 is constructed to guide an insertion direction when each arm 340 is inserted into the arm engaging groove 611 and to transfer a rotational force of the arm 340 to the socket. It is preferred that the arm engaging unit 610 is equipped with a hexagonal cross section to correspond to the engaging groove 343 of the arm 340.

An outer surface of the arm engaging unit 610 is knurled, and a second ball plunger 610*a* formed of a ball and a spring is provided in one side of the inner surface of the arm engaging unit 610, and an elliptical plunger groove 344 corresponding to the second ball plunger 610*a* is formed in one side of an outer surface of each arm 340, respectively.

The second ball plunger 610*a* allows the ball to be inserted into the plunger groove 344 of the arm 340 by means of the elastic recovery force of the spring when the arm 340 is inserted into the arm engaging groove 611, so the adaptor 600 keeps a stable engagement state in the lower side of the arm 340.

A third ball plunger 621 is preferably formed in one side of the socket engaging unit 620 so that the socket engagement unit 620 can be inserted into the socket groove of the wrench socket.

The process for engaging and disengaging the bolt using the ratchet wrench 100 according to an embodiment of the present invention will be described with reference to FIG. 78.

When it is needed to engage the bolt B, the control lever 230 is rotated, and the tooth member 221*a* of the engaging steps among the tooth members 221*a* and 221*b* of both ends of one side of the stop member 220 provided in the body unit 200 is engaged with the ratchet gear 320 engaged in an outer rim of the housing 310 of the head unit 300.

The worm screw 330 exposed to the outside of the worm screw insertion groove 311 formed on an upper surface of the housing 310 is rotated in one direction or in the other direction. A pair of the arms 340 engaged with the worm screw is widened or narrowed with each other and is fixed while compressing the head of the bolt B from their both sides.

The handle unit 400 is rotated in the clockwise direction when viewing on the drawings, and the body unit 200 is rotated in the clockwise direction, and the stop member 220 pushes the ratchet gear 320, and the head unit 300 rotates in the clockwise direction.

As the head unit 300 rotates in the clockwise direction, the bolt head fixed in the arm 340 of the head unit 300 is rotated in the clockwise direction, and the body unit 200 and the head unit 300 rotate at certain angles and rotate the handle unit 400 in the counterclockwise direction, and the body unit 200 returns to its original position. So, the bolt B is engaged as the above operations are repeatedly performed in the clockwise direction.

FIG. 8 shows a bolt B having a hexagonal bolt head. The shape of the same is not limited to the hexagonal shape. More specifically, it might be a rectangular shape, a butterfly shape, or the like. The shape of the engaging groove 343 of the arms 340 should correspond to the shape of the bolt head.

When it is needed to disengage the bolt B, the control lever 230 is rotated in the counterclockwise direction when viewing on the drawing, and the tooth member 221*b* of the disengaging step among the tooth members 221*a* and 221*b* of both ends of one side of the stop member 220 is engaged with the ratchet gear 320.

The handle unit 400 is rotated in the counterclockwise direction when viewing on the drawing, and the body unit 200 is rotated in the counterclockwise direction, so the tooth member 221*b* of the stop member 220 pushes the ratchet gear 320, and the head unit 300 rotates in the counterclockwise direction.

Since the head of the bolt B is fixed in the arm 340 of the head unit 300, the bolt B is rotated in the counterclockwise direction and is disengaged. In this case, the body unit 200 and the head unit 300 are rotated at certain angles, and the handle unit 400 is rotated in the clockwise direction, and the body unit 200 returns to its original position. The bolt B is disengaged as the above operations are repeatedly performed in the counterclockwise direction.

Figure 1:
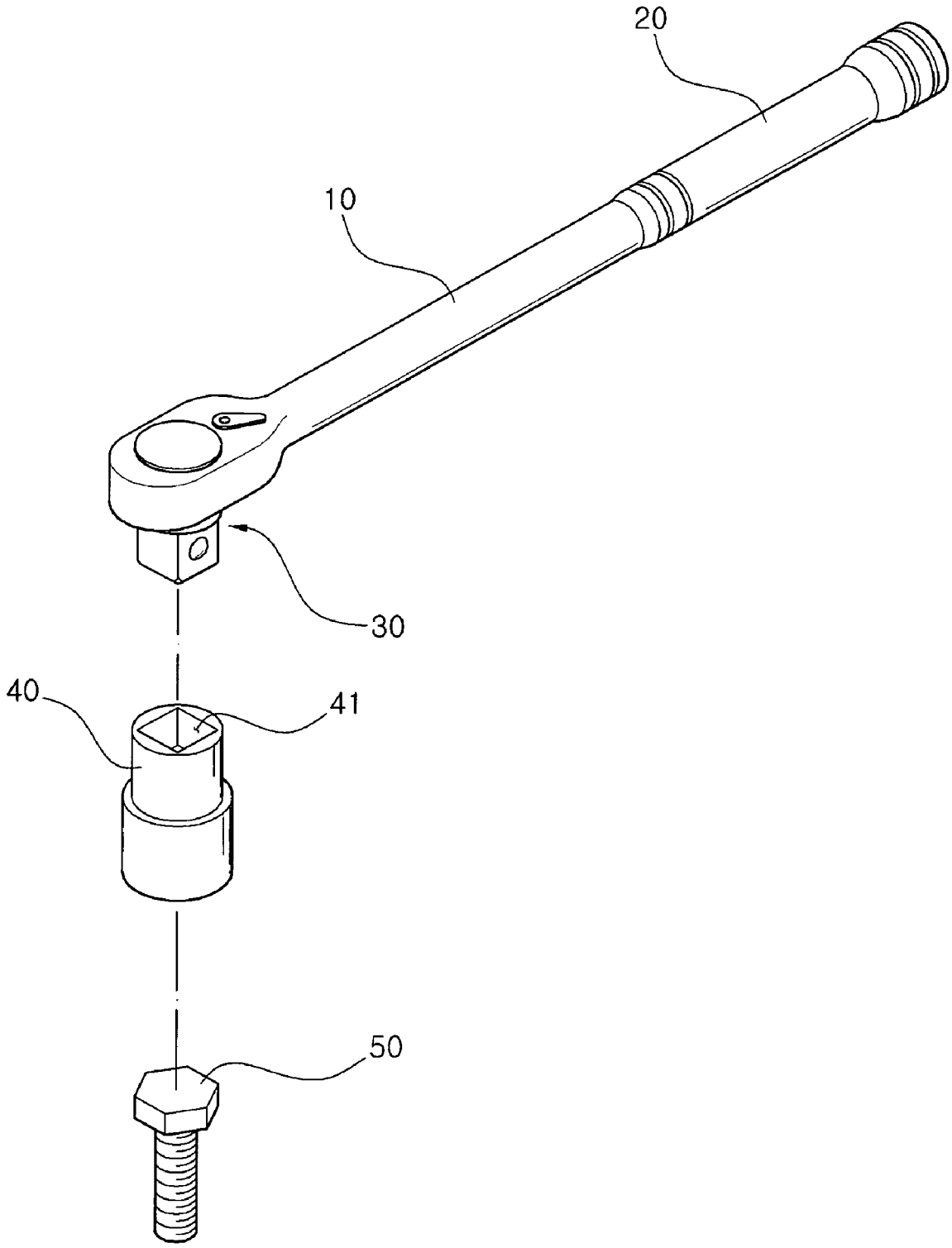
Fig. 1 Prior art
FIG. 1 is a perspective view illustrating a construction of a conventional ratchet wrench.

As described earlier, in the present invention, it is possible to engage or disengage various size bolts without changing the socket. As the socket is engaged to the lower side of the arm 340 by using the adaptor 600, the conventional socket 40 might be used also as shown in FIG. 1.

When it is needed to engage the socket 40, the worm screw 330 is rotated, and a pair of the arms 340 are made closely contacted with each other with their opposite surfaces being contacted, and each arm 340 is inserted into the arm engaging groove 611 of the adaptor 600. As the ball of the second ball plunger 610*a* provided in one side of an inner surface of the arm engaging unit 610 is fixedly inserted into the plunger groove 344 fowled in one side of the outer surface of the arm 340, the adaptor 600 is engaged to the arm 340.

When the socket engaging unit 620 is inserted into the socket groove 41 of the socket 40, which will be used, the third ball plunger 621 provided in one side of the socket engaging unit 620 is fixedly inserted into the plunger groove (not shown) provided in the socket groove 41, so the socket 40 is engaged to the adaptor 600, and the engaging and disengaging processes of the bolts are continued.

Namely, the present invention can be usefully applied when it is needed to engage to or disengage the bolt from the deep groove of the work object.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A ratchet wrench, comprising:

a body unit which has a circular groove at a first side and a stop member;

a head unit which includes a housing rotatably passing through a circular groove of the body unit, and a ratchet gear engaged at an outer rim of the housing and is selectively rotatable in one direction as the ratchet gear is engaged with the stop member;

a worm screw which is rotatably pin-engaged in an interior of the housing; and a pair of arms of which one end of each arm is inserted into the interior of the housing and is pin-engaged therein with a thread being formed on an upper side of each arm and being engaged with the worm screw; and an adaptor having an upper portion which is detachably engaged to a lower end of each arm, and a lower portion which is detachably attachable to a wrench socket, wherein said adaptor includes (a) an arm engaging unit having an arm engaging groove formed in an interior of the upper portion and a guide unit protruding from a center of the arm engaging groove, and (b) a socket engaging unit which has a rectangular cross section and protrudes away from the arm engaging unit.

2. The wrench of claim 1, wherein a control lever is provided in an outer side of the body unit and is connected with the stop member with an adjusting pin for thereby allowing the stop member to rotate.

3. The wrench of claim 1, wherein said stop member is triangular and has first and second sides, the first side of the stop member having two ends and being equipped with a tooth member at each of the ends for engaging with the ratchet gear, the second side of the stop member having a pair of circular curved parts that are near to each other on the second side of the stop member.

4. The wrench of claim 1, wherein said housing is formed in a cylindrical shape having a space in its interior with a rectangular worm screw insertion groove for engagement with the worm screw, and with an arm guide groove in its lower surface for a slide movement of the pair of arms.

5. The wrench of claim 1, wherein said worm screw is constructed such that threads are symmetrical with each other with respect to its center and the pair of arms rotate in opposite direction to each other depending on the rotation of the worm screw.

6. The wrench of claim 1, wherein said pair of arms are equipped with opposite plane surfaces.

7. The wrench of claim 6, wherein a V-shaped engaging groove is formed on each of the opposite surfaces of the arms.

8. The wrench of claim 7, wherein an arcuate groove is further formed in a curved portion of the engaging groove.

9. The wrench of claim 1, wherein a cover having a through hole is formed at a lower side of the body unit, and a lower end of the housing is exposed to the outside through the through hole.

10. The wrench of claim 1, wherein a ball plunger is disposed at one side of an inner surface of the arm engaging unit, and a plunger groove corresponding to the ball plunger is formed at one side of an outer surface of each arm.

11. The wrench of claim 1, wherein a ball plunger is provided at one side of the socket engaging unit for engagement with the wrench socket.

12. The wrench of claim 1, wherein a handle unit made of a rubber or a synthetic resin material is provided on an outer surface of a second side of the body unit for preventing sliding.

13. The wrench of claim 3, further comprising plunger means, including a ball, for generating an elastic recovery force upon rotation of the stop member that causes the ball to slide into close contact with a first of the circular curved parts when the stop member is rotated to a first position and to slide into close contact with a second of the circular curved parts when the stop member is rotated to a second position.

* * * * *